US005660119A

United States Patent [19]

Perkins

[11] Patent Number: 5,660,119

[45] Date of Patent: Aug. 26, 1997

[54] LIGHTWEIGHT STRUCTURAL BEAM

[75] Inventor: David W. Perkins, Hiawatha, Iowa

[73] Assignee: Plastic Systems, Inc., Des Moines, Iowa

[21] Appl. No.: 672,405

[22] Filed: Jun. 28, 1996

[51] Int. Cl.[6] ..... B65D 19/00

[52] U.S. Cl. ..... 108/51.3; 108/56.3

[58] Field of Search ..... 108/51.3, 51.1, 108/56.1, 56.3

[56] References Cited

U.S. PATENT DOCUMENTS

| | | | |
|---|---|---|---|
| 2,444,183 | 6/1948 | Cahners | 108/51.3 |
| 2,609,136 | 9/1952 | Sider | 108/51.3 X |
| 2,904,297 | 9/1959 | Hamilton | 108/51.3 |
| 3,464,370 | 9/1969 | Martin | 108/51.3 |
| 4,102,525 | 7/1978 | Albano . | |
| 4,303,020 | 12/1981 | Houle | 108/51.3 |
| 4,563,377 | 1/1986 | Melli . | |
| 4,638,745 | 1/1987 | Sheffer | 108/56.3 X |
| 4,864,940 | 9/1989 | Dunn | 108/51.3 |
| 5,423,270 | 6/1995 | Kilpatrick et al. | 108/51.3 |
| 5,517,926 | 5/1996 | Young, Jr. | 108/51.3 |

*Primary Examiner*—Jose V. Chen

*Attorney, Agent, or Firm*—Merchant, Gould, Smith, Edell, Welter & Schmidt

[57] ABSTRACT

A lightweight beam is formed from a single sheet of cardboard, and a pallet is constructed using the lightweight beam. A number of folds are pre-scored on the sheet of cardboard, forming a diagonal panel, a securable panel on one side of the diagonal panel, and a plurality of structural panels on the other side of the panel. The beam is assembled by folding the securable panel in a first direction and then folding the structural panels in a second direction using a rolling action, thus simplifying the assembly of the beam. The beam has double-walled sides to provide strength in the vertical direction in the pallet. The beam is provided with interlocking tabs which prevent the beam from disassembling, and which avoid the need for adhesives.

9 Claims, 5 Drawing Sheets

LIGHTWEIGHT STRUCTURAL BEAM

BACKGROUND OF THE INVENTION

1. Field of the Invention

This invention relates in general to a lightweight structural beam and, in particular, to a beam of folded corrugated cardboard for use in lightweight pallets.

2. Description of Related Art

Disposable corrugated cardboard pallets are known for use in areas where a lightweight pallet is required, for instance in transporting a number of boxes of foodstuffs such as boxes of cereal. Typically, the cardboard pallet is stored as a collection of flat cardboard sheets. Box beams are assembled by folding a flat sheet of cardboard which has been provided with a number of pre-scored folds, and gluing one or more flaps in place with an adhesive to prevent the box beam from disassembling. The pallet is subsequently constructed by sandwiching a number of assembled box beams between upper and lower platforms.

There have been a number of attempts at designing a box beam which is simple to assemble. A known example is disclosed in U.S. Pat. No. 4,563,377, which is directed to a corrugated cardboard beam composed of a single sheet of cardboard folded back on itself a number of times. The corrugated cardboard beam has two halves, one the mirror-image of the other, and each half composed of a diagonal section with the cardboard symmetrically folded back several times on itself on either side of the diagonal section. The corrugated cardboard beam is provided with suitable adhesive zones.

A difficulty with the corrugated cardboard beam of U.S. Pat. No. 4,563,377 is that it has a complex shape, requiring many folds to be made towards both sides of the cardboard sheet, thus making assembly of the cardboard beam difficult. In addition, the cardboard beam requires the use of adhesive to complete assembly. The need for glue introduces an extra step into the assembly process, increases assembly and material costs, and reduces the ability of the beam to be recycled.

There is therefore a need for a cardboard box beam which is simpler to assemble than existing box beams, but which retains the same high strength. A reduction in assembly complexity may be achieved by using fewer folds and also by ordering the folds so that the box beam requires fewer folds towards one of the surfaces of the cardboard sheet. In addition, there is also a need to avoid the requirement of providing adhesive during the assembly process, thus reducing cost and increasing recyclability.

SUMMARY OF THE INVENTION

To minimize the limitations in the prior art described above, and to minimize other limitations that will become apparent upon reading and understanding the present specification, the present invention discloses a lightweight beam formed from a single sheet of cardboard, and a pallet constructed using the lightweight beam. A number of folds are pre-scored on the sheet of cardboard, forming a diagonal panel, a securable panel on one side of the diagonal panel and a plurality of structural panels on the other side of the panel. The beam is assembled by folding the securable panel in a first direction and then folding the structural panels in a second direction using a rolling action, thus simplifying the assembly of the beam. The beam has double-walled sides to provide strength in the vertical direction in the pallet. The beam is provided with interlocking tabs which prevent the beam from disassembling, and which thus avoid the need for adhesives. The beam may also have additional support means to provide extra strength.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

The purpose of a lightweight beam is to allow the fabrication of lightweight pallets for use in, for example, food manufacturing facilities, for handling large quantities of relatively light foodstuffs such as boxes of cereal etc. The lightweight beam is designed to be stored as a pre-shaped flat sheet and assembled on an as-needed basis. In addition, the lightweight beam is designed to maintain its shape without the use of adhesives.

Figure 1:
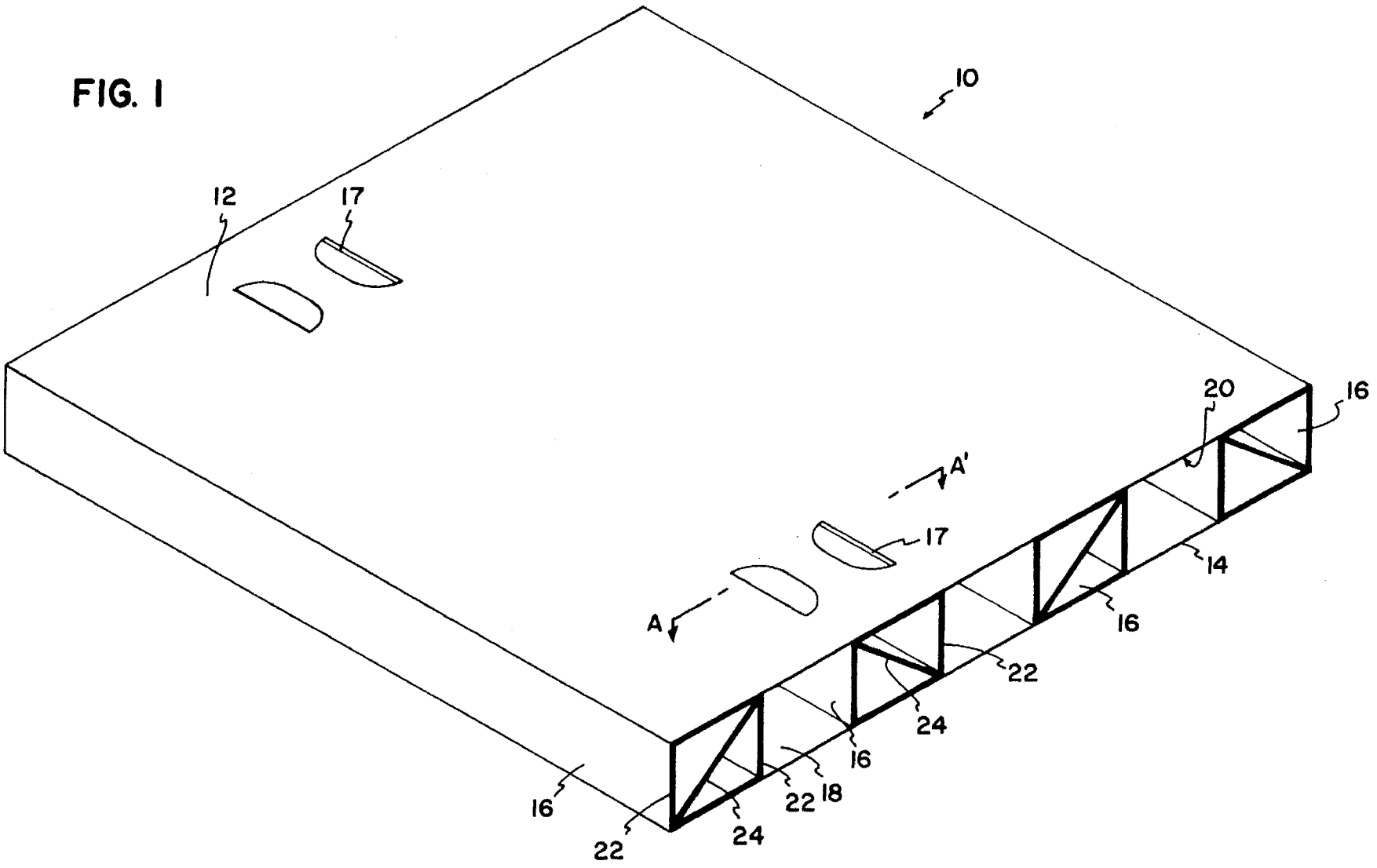
FIG. 1 illustrates a lightweight pallet according to the present invention.

A lightweight pallet constructed according to the present invention is illustrated in FIG. 1. The pallet, generally shown as element 10, has an upper sheet 12 and a lower sheet 14. The upper sheet 12 and lower sheet 14 are preferably both made of double wall corrugated cardboard, such as is commonly used in shipping cartons. The upper sheet 12 and lower sheet 14 are held together by a number of lightweight beams 16, which are formed from folded double walled corrugated cardboard. The pallet 10 is constructed by attaching lower surfaces of the lightweight beams 16 to an upper surface 18 of the lower sheet 14, typically using an adhesive such as glue or, alternatively, an equivalent method such as stapling. The upper surfaces of the lightweight beams 16 are attached to the lower surface 20 of the upper sheet 12 in a similar manner.

Each lightweight beam 16 is provided with two layers of double walled corrugated cardboard on each of the two sides 22, so as to provide extra strength in the vertical direction, along with a diagonal panel 24 which increases the horizontal shear strength of the lightweight beam 16. The shear strength of the lightweight beam 16 is greater for shear acting in one direction than shear acting in the opposite direction, as is discussed hereinbelow. Therefore, the pallet 10 preferably has the lightweight beams 16 disposed with the diagonal panels 24 having alternating orientation, as is shown in FIG. 1, an arrangement which provides for equal shear strength for both directions of shear.

It is understood that the lightweight beams 16 are spaced within the pallet 10 according to the expected pallet loading and the strength of the lightweight beams 16. In addition, the lightweight beams 16 may also be spaced within the pallet 10 so as to accommodate the forks of a fork-lift. The pallet 10 may be of any useful size and may include as many lightweight beams 16 as may be required to sustain the expected load, within design limits. Also, the length of the lightweight beam 16 across the pallet is not restricted, but typically ranges from 24 inches to 60 inches for most practical applications.

Figure 2:
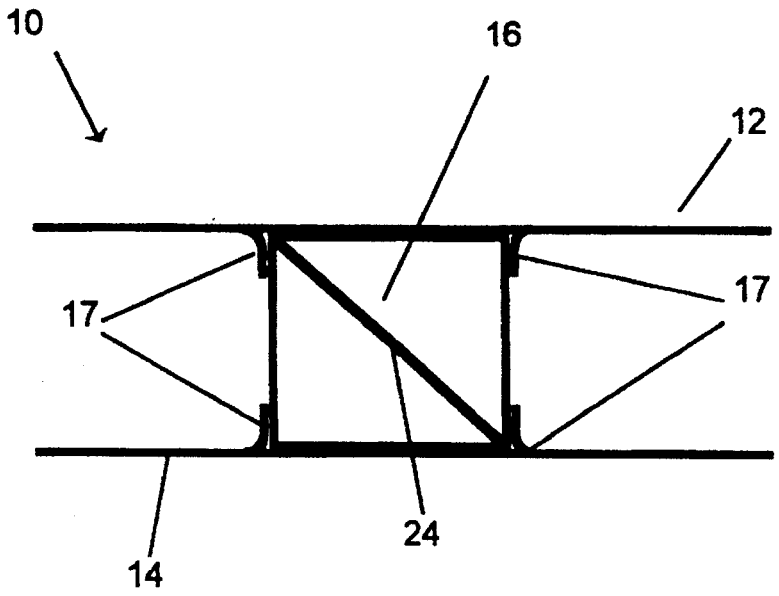
FIG. 2 illustrates a partial cross-section of the pallet of FIG. 1, along section line AA'.

The upper and lower sheets 12 and 14 may be provided with a plurality of alignment tabs 17, formed in the upper and lower sheets 12 and 14 by a die-cutting process. Each alignment tab 17 folds into the pallet to grip the side of a lightweight beam 16. Alignment of a lightweight beam 16 is preferably performed using four alignment tabs 17 on each of the upper and lower sheets 12 and 14, two for each side 22 of the lightweight beam 16. FIG. 2 illustrates a partial cross-section of the pallet through section AA', taken as shown in FIG. 1. The partial cross-section shows part of a pallet with a single lightweight beam 16 disposed between an upper sheet 12 and a lower sheet 14. The alignment tabs 17, which have been folded into the pallet 10 align the sides of the lightweight beam 16, maintaining the lightweight 16 in the desired position within the pallet 10.

Figure 3:
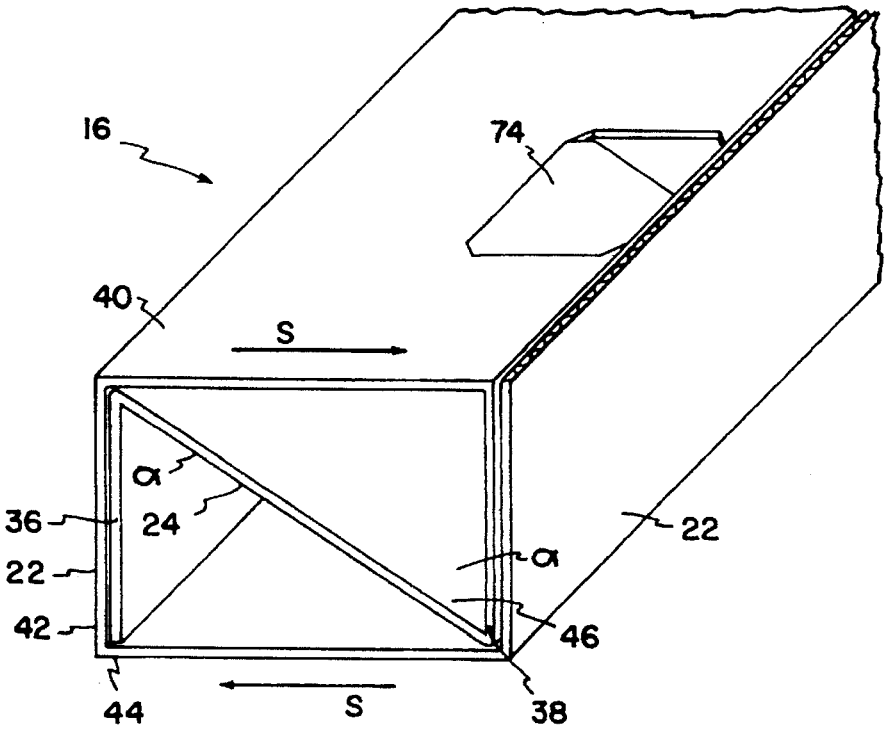
FIG. 3 illustrates a folded lightweight beam according to the present invention.
Figure 4:
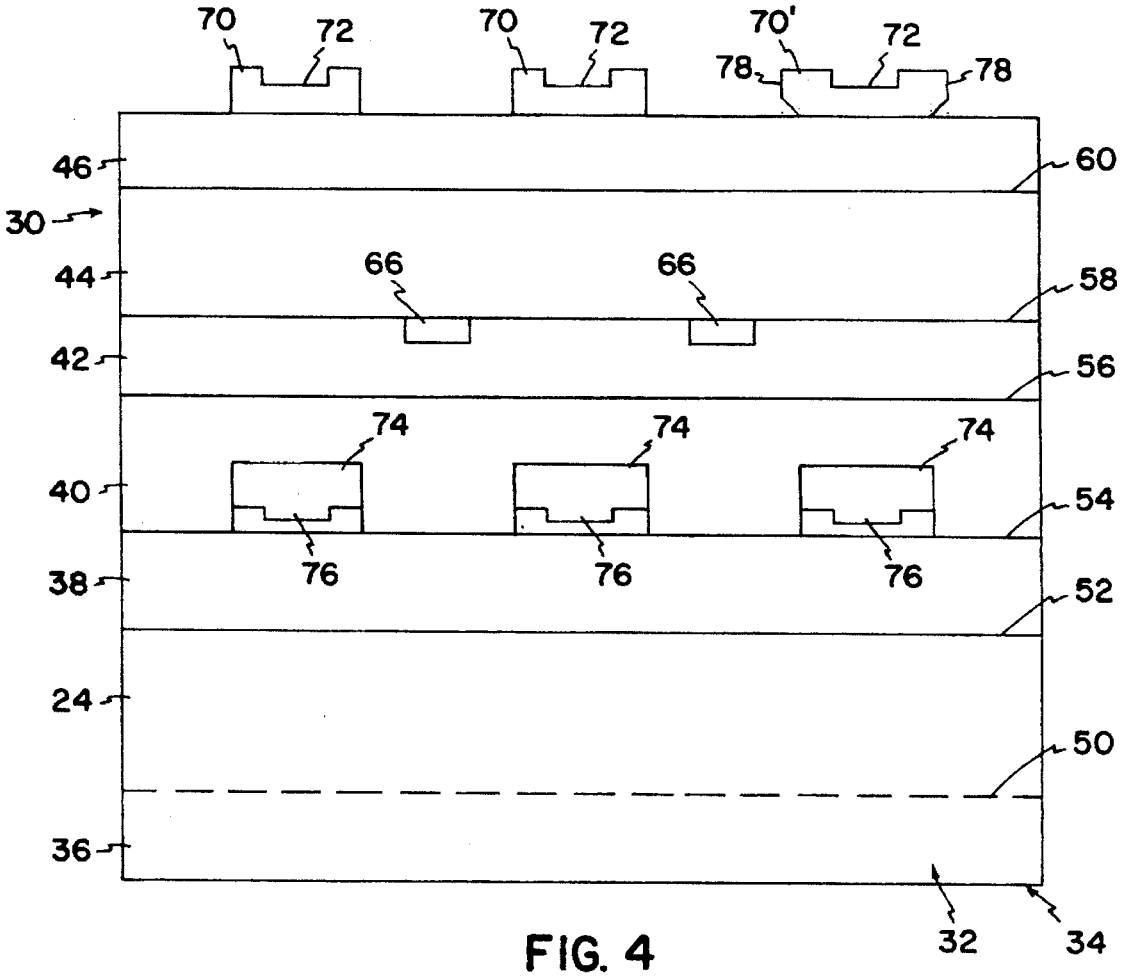
FIG. 4 illustrates an unfolded lightweight beam of a first embodiment of the invention.

A description of the construction of the lightweight beam is now given, referring to FIGS. 3 and 4. FIG. 3 illustrates a folded lightweight beam 16. FIG. 4 illustrates a flat sheet of cardboard 30 from which the lightweight beam 16 is assembled. The flat sheet of cardboard 30 has an upper surface 32, a lower surface 34, and a plurality of fold lines separating a plurality of panels.

Referring first to FIG. 3, the lightweight beam 16 has a securable panel 36 which lies vertically on the inside of the lightweight beam 16 at one side 22. Connected to the securable panel 36 is the diagonal panel 24, which lies diagonally within the lightweight beam 16 to provide shear strength. Connected to the other edge of the diagonal panel 24 is a first structural panel 38, which lies vertically on another side 22 of the lightweight beam 16 opposite the securable panel 36. Connected to the first structural panel 38 is a second securable panel 40, which lies across the top of the lightweight beam 16. A third structural panel 42 is connected to the second structural panel 40. The third structural panel 42 lies vertically on the outside of the lightweight beam, adjacent the securable panel 36. Together, the third structural panel 42 and the securable panel 36 form a double wall on a side 22 of the lightweight beam 16. A fourth structural panel 44 is connected to the third structural panel 42, and forms the bottom of the lightweight beam 16. The fourth structural panel 44 is connected to a fifth structural panel 46, which lies vertically on the outside of the lightweight beam 16 adjacent the first structural panel 38. Together, the first structural panel 38 and the fifth structural panel form a double wall on another side 22 of the lightweight beam 16.

The diagonal panel 24 forms equal angles $\alpha$ (alpha) with the securable panel 36 and the first structural panel 38. The lightweight beam 16 has high resistance to shear operating in the direction indicated by arrows marked A, since shear acting in this direction compresses the diagonal panel 24, pushing the individual panels of each double-walled side 22 together. The beam has less resistance to shear acting in the direction opposite to A, since the diagonal panel 24 is then pulled under tension, which may result in the separation of the panels making up the double-walled sides of the lightweight beam 16.

Folds may be formed on a sheet of double-walled corrugated cardboard by impressing score fold lines on the surface which forms the inside of the fold. Alternatively, perforation fold score lines, which require forming perforations on both sides of the double-walled corrugated cardboard, may be used. Perforation fold score lines allow folding of the cardboard in either direction but are more labor intensive to produce. Perforation folds also weaken the cardboard sheet more than a simple fold score. The following description of forming folds on a sheet to enable construction of a lightweight beam 16 is directed to scoring fold lines. The use of perforation score lines is equally applicable to the following description of the preferred embodiments.

Referring now to FIG. 4, the securable panel 36 is folded in a direction towards the lower surface 34 of the flat sheet of cardboard 30. Thus the securable panel fold line 50, lying between the securable panel 36 and the diagonal panel 24, is scored on the lower surface 34, and is shown as a dashed line. All other folds are directed towards the upper surface 32 and so the remaining fold lines are scored on the upper surface 32, shown as solid lines. The first fold line 52 lies between the diagonal panel 24 and the first structural panel 38. The second fold line 54 lies between the first structural panel 38 and the second structural panel 40. The third fold line 56 lies between the second structural panel 40 and the third structural panel 42. The fourth fold line 58 lies between the third structural panel 42 and the fourth structural panel 44. The fifth fold line 60 lies between the fourth structural panel 44 and the fifth structural panel 46. The securable panel fold lines 50 and the structural panel fold lines 52–60 preferably all lie perpendicular to the corrugations so as to increase the strength of the lightweight beam 16.

The lightweight beam 16 may be formed in a straightforward manner by first folding the securable panel 36 about the securable panel fold line 50 to form the angle $\alpha$ with the diagonal panel 24, and then folding the remainder of the sheet about the first fold line 52, second fold line 54, third fold line 56, fourth fold line 58, and fifth fold line 60. Since the structural panel fold lines 52–60 are all scored on the same side of the cardboard sheet 30, folding the cardboard sheet 30 about these fold lines 52–60 may advantageously be performed in a "rolling" action. This "rolling" action is faster and simpler than the beam-forming steps required for prior art corrugated cardboard beams.

Since the lightweight beam 16 is formed from a "roll", it is understood that structural panels on the inside of the lightweight beam 16 are narrower in width than adjacent panels on the outside of the lightweight beam 16. The width of a panel is the distance separating the fold line on either side of the panel or, if an end panel, the fold line and the outside edge. In illustration, referring to FIG. 5, the first structural panel 38 is narrower than the fifth structural panel 46, since the fifth structural panel 46 has to accommodate the thickness of the second and fourth structural panels 40 and 44. Likewise, securable panel 36 is narrower than the third structural panel 42, since the third structural panel 42 has to accommodate the thickness of the top and bottom panels. In addition, the width of the fourth structural panel 44 is greater than the width of the second structural panel 40 in order to accommodate the thickness of the first structural panel 38.

The fifth structural panel 46 is attached to the first structural panel 38 in order to hold the first and fifth structural panels 38 and 46 together and prevent the lightweight beam 16 from disassembling. Preferably, the fifth structural panel 46 is attached by the use of interlocking tabs provided on the flat sheet of cardboard 30, thus avoiding the use of an adhesive.

Figure 5:
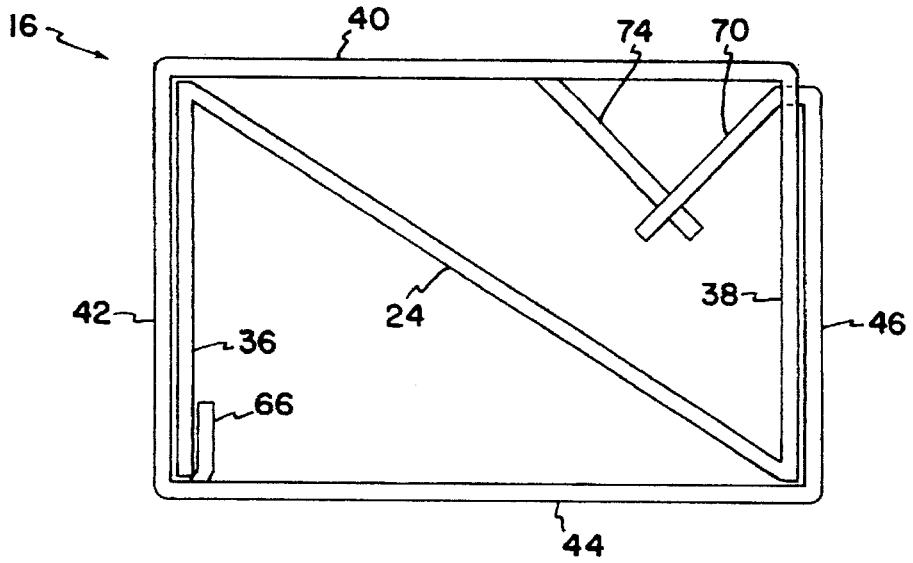
FIG. 5 is a view from an end of the assembled lightweight beam of the first embodiment of the invention, illustrating the interlocking tabs and the securing tab.

The flat sheet of cardboard 30 has a plurality of outer tabs 70 formed, preferably by a die-cutting process, on the outer edge of the fifth structural panel 46. Each outer tab 70 is provided with a slotted portion 72. FIG. 5 illustrates an outer tab 70 mating with a respective inner tab 74 formed on the second structural panel 40, preferably as a cut-out using a die-cutting process. The inner tab 74 is provided with a protruding tab portion 76. After the lightweight beam 16 is assembled, the outer and inner tabs 70 and 74 are both depressed into the lightweight beam 16 and the protruding tab portion 76 interlocks with the slotted portion 72 of the outer tab 70, allowing the outer edge 78 of the inner tab 74 to rest on the outer tab 70, thus locking the outer tab 70 in place and preventing the lightweight beam 16 from disassembling. Alternatively, it is understood that the outer and inner tabs 70 and 74 may each be respectively provided with a protruding tab portion and a slotted portion in order to interlock, or the outer and inner tabs 70 and 74 may be provided with some other method of interlocking, so that the outer tab 70 is prevented from folding out of the lightweight beam 16 and letting the lightweight beam 16 disassemble. An alternative elongated outer tab 70' has wing portions 78, to give a length which is greater than the length of the corresponding inner tab 74'. The wing portions 78 of the elongated outer tab 70' may engage the edges of the hole produced in the blank by die-cutting the inner tab 74', resulting in an increased degree of interlocking, and improved protection against the lightweight beam 16 from disassembling.

It is understood that other methods of attaching two structural panels may be used for preventing the lightweight beam 16 from disassembling, such as staples, adhesive, adhesive tape, paper fasteners, or rubber bands.

The securable panel 36 is held in place in order to maintain a double-walled side 22 by preventing the securable panel 36 from bending away from the third structural panel 42. The securable panel 36 is preferably held in place by a securing tab 66 which is die-cut as a cut-out in the third structural panel 42 at the fourth fold 58. When assembling the lightweight beam 16, the securable panel 36 is slipped behind the securing tab 66, thus self-securing the securable panel 36, i.e. holding the securable panel 36 in place without the use of adhesive. An end view of the assembled lightweight beam 16 is shown in FIG. 5, which illustrates the securing tab 66 holding the securable panel 36 vertically in place, lying parallel to the third structural panel 42. The securable panel 36 may alternatively be held in place by providing adhesive between contacting surfaces of the securable panel 36 and the third structural panel 42.

Figure 6:
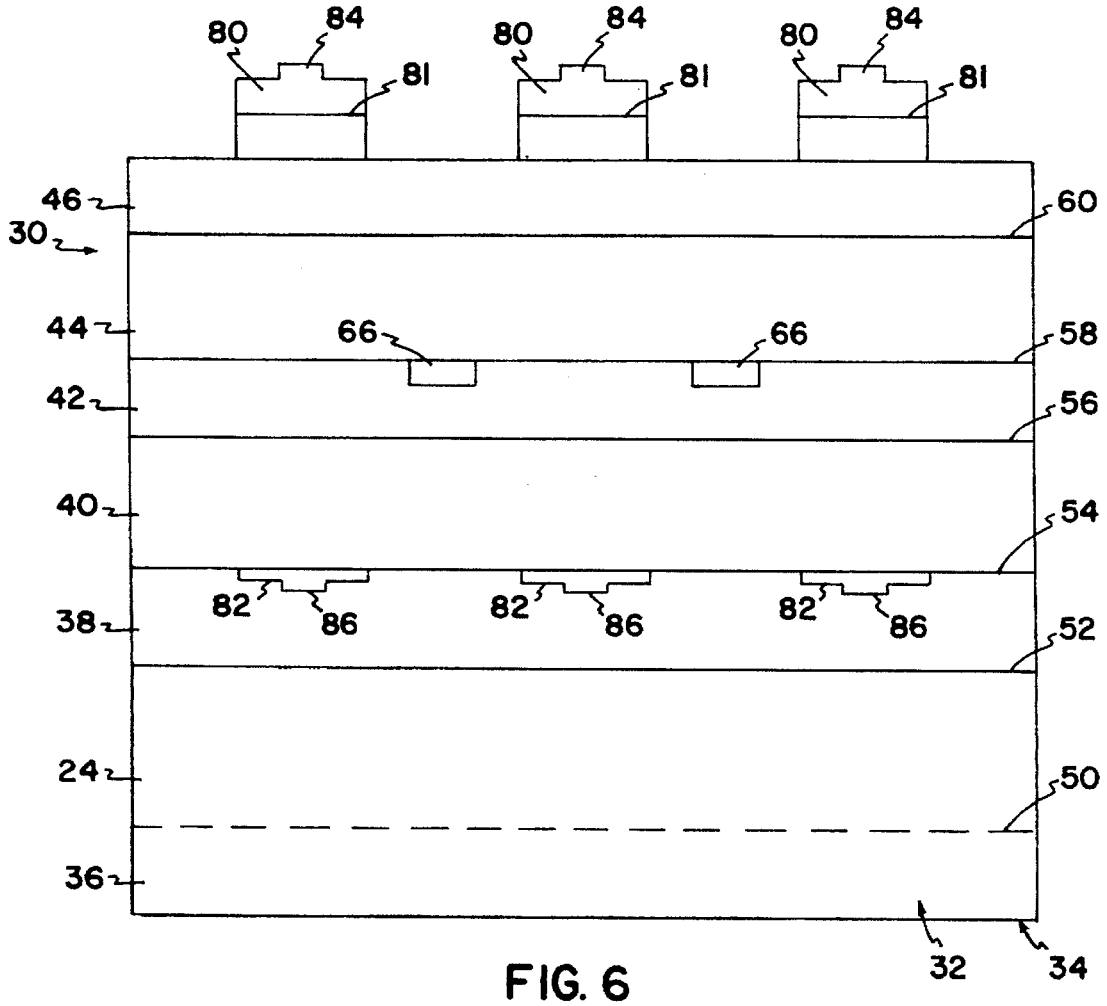
FIG. 6 illustrates an unfolded lightweight beam of a second embodiment of the lightweight beam.
Figure 7:
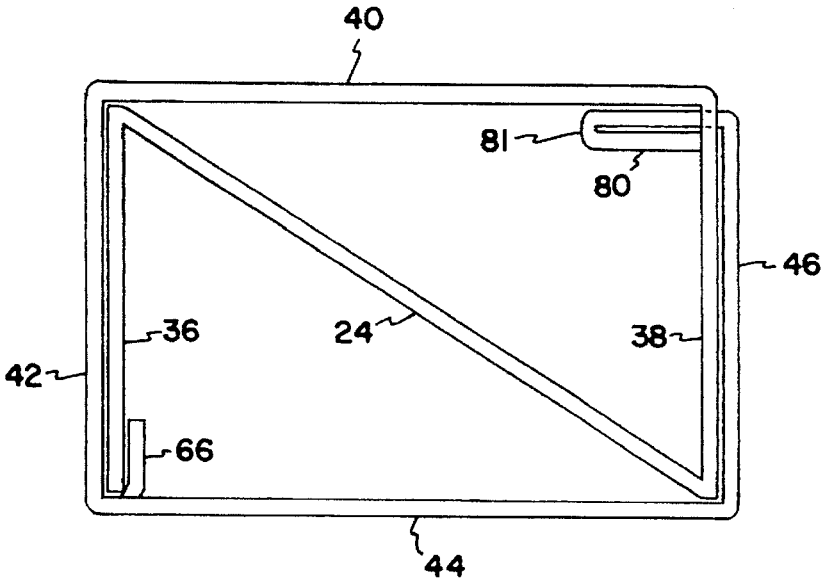
FIG. 7 is a view from an end of the assembled lightweight beam of the second embodiment of the invention, illustrating the folded tab.

A second embodiment of the lightweight beam 16 is illustrated in FIGS. 6 and 7. Elements which are the same as the first embodiment illustrated in FIGS. 3–5 are identified with the same label number. In this second embodiment, the lightweight beam is provided with alternate attaching means for preventing the lightweight beam 16 from disassembling. Instead of interlocking tabs, the second embodiment includes folded tabs 80 positioned at the edge of the fifth structural panel 46. The folded tabs 80 have tab fold lines 81 extending thereacross and are inserted through folded tab slots 82 located in the first structural panel 38 proximate the second fold 54. The folded tabs 80 are illustrated in an unfolded position in FIG. 6. The folded tabs 80 are folded about tab fold lines 81 prior to insertion in folded tab slots 82. Since the folded tabs 80 are preferably folded towards the upper surface 32, the tab fold lines 81 are shown as solid lines. FIG. 7 illustrates a cross-section of an assembled lightweight beam 16, showing a folded tab 80 in place for preventing the lightweight beam 16 from disassembling. Additional protection against the lightweight beam 16 disassembling is provided by a protruding portion 84 on the folded tab 80 and a complementary protruding slot portion 86. When the folded tab 80 is inserted in slot 82, the protruding portion 84 catches in the complementary protruding slot portion 86 so as to prevent the folded tab 80 from unfolding within the lightweight beam 16. Preventing the folded tab 80 from folding reduces the likelihood of the lightweight beam 16 disassembling when in use. It is understood that the lightweight beam 16 would normally be provided with either a set of interlocking tabs 70 and 74 or a set of folded tabs 80 for preventing the lightweight beam 16 from disassembling.

Figure 8:
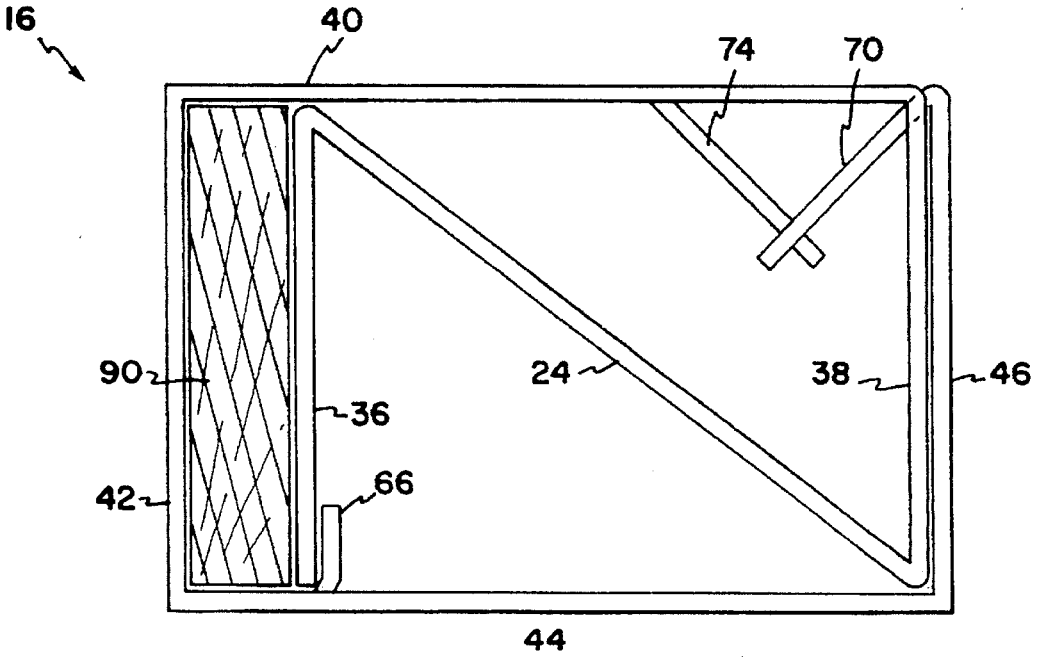
FIG. 8 illustrates a third embodiment of the lightweight beam with additional strengthening.

A third embodiment of the lightweight beam 16 is illustrated in FIG. 8. In this third embodiment, the lightweight beam 16 is augmented with a wooden support member 90 to provide increased strength in the vertical direction. The second and fourth structural panels 40 and 44 extend beyond the securable panel 36 to create a pocket between the securable panel 36 and the third structural panel 42. This pocket accepts the wooden support member 90. The wooden support member 90 may be held in place within the lightweight beam 16 by using adhesive between the faces of the wooden support member 90 and either of the contacting surfaces of the securable panel 36 and the third structural panel 42. The wooden support member 90 may also be held in place without the use of adhesives by the securable panel 36 locked in position by the securing tab 66.

Figure 9:
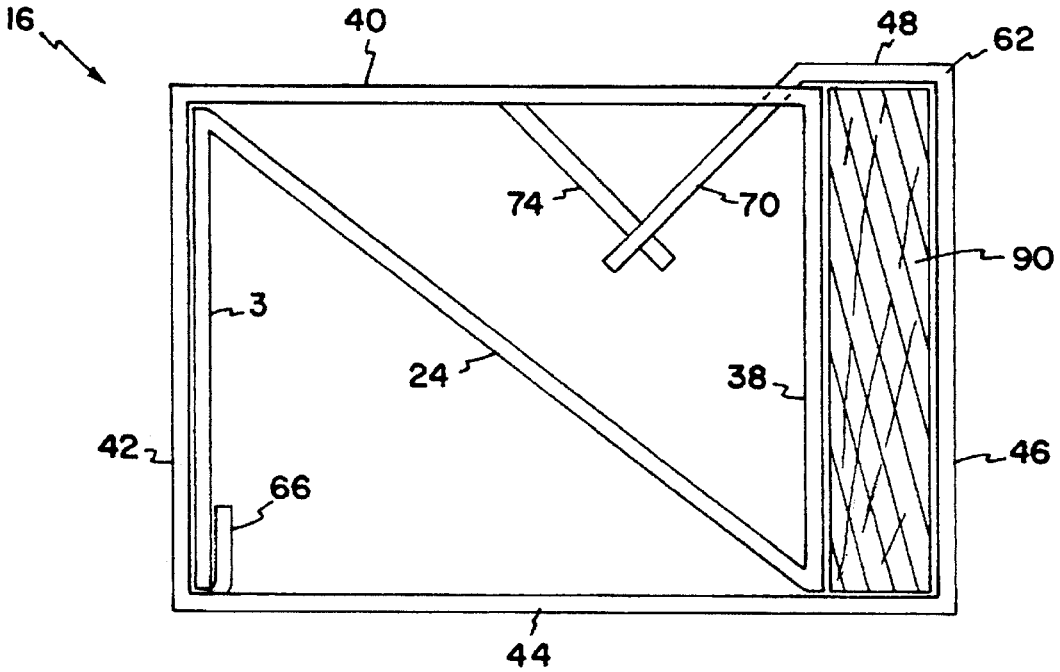
FIG. 9 illustrates a fourth embodiment of the lightweight beam with additional strengthening.

A fourth embodiment of the lightweight beam 16 is illustrated in FIG. 9, which shows the use of a wooden beam 82 for augmenting vertical strength. The wooden beam 90 is located within a pocket whose lower portion is formed by an extended fourth panel 44. The top of the pocket is formed by a sixth structural panel 48 which extends from the fifth structural panel 46 and is separated from the fifth structural panel 46 by a sixth fold 62. The outer tab 70 extends from the sixth structural panel 48 to interlock with the inner tab 74. The wooden support member 90 may be held in place within the lightweight beam 16 by using adhesive between the faces of the wooden support member 90 and either of the contacting surfaces of the first structural panel 38 and the fifth structural panel 46.

To summarize, we have described a pallet 10, and a lightweight beam 16 used to make the pallet 10, which are formed from double-walled corrugated cardboard. The lightweight beam 16 demonstrates high strength in a selected transverse direction by the inclusion of double-walled sides 22. The lightweight beam 16 may be completely assembled without the use of adhesives, thus reducing the time required to construct a pallet 10. The lightweight beam 16 may also be provided with an additional support member 90 for increased strength over that afforded by the double-walled sides alone.

It is understood that the embodiments discussed herein are not mutually exclusive. For example, one may introduce a wooden support member into a lightweight beam which is held together using folded tabs rather than interlocking tabs.

The foregoing description of the preferred embodiment of the invention has been presented for the purposes of illustration and description. It is not intended to be exhaustive or to limit the invention to the precise form disclosed. Modifications and variations are possible in light of the above teaching. It is intended that the scope of the invention be limited not by this detailed description, but rather by the claims appended hereto.

What is claimed is:

1. A lightweight beam, comprising:

a generally rectangular blank of paper-based construction material, having fold lines longitudinal thereupon, said blank having opposite first and second surfaces, said fold lines being placed in parallel arrangement to form securable, diagonal and structural panels intermediate said fold lines, a first of said fold lines being scored for bending the first surface of said blank inwardly, said first fold line being on a first side of said diagonal panel, between said diagonal panel and said securable panel, additional of said fold lines being scored for bending the second surface of said blank inwardly, said additional fold lines being on a second side of said diagonal panel, to form a plurality of structural panels, said structural panels being folded in a same direction about said additional fold lines of said plurality of said fold lines into substantially perpendicular relationship to form a beam;

said securable panel and one of said plurality of structural panels being adjacent said diagonal panel with each being folded into acute angle relationship with said diagonal panel; and means for securing said securable panel and one of said structural panels so as to inhibit said lightweight beam from disassembling, said securing means including first and second interlocking tabs, said first interlocking tab being formed as a cut-out on said one of said structural panels and said second tab being formed on an edge of said securable panel.

2. The lightweight beam of claim 1, wherein said securing means is adhesiveless.

3. The lightweight beam of claim 1, wherein a first of said pair of interlocking tabs has a protruding portion and a second of said pair of interlocking tabs has a slotted portion, said protruding portion entering said slotted portion so as to cause said pair of interlocking tabs to interlock.

4. The lightweight beam of claim 1, wherein said securing means comprises a folded tab disposed on an edge of one of said structural panels, said folded tab being received in a slot on another of said structural panels, said folded tab being provided with a protruding portion to interlock with a protruding slot portion of said slot so as to prevent said folded tab from unfolding.

5. The lightweight beam of claim 1, further comprising a separate support member for augmenting strength of the lightweight beam, said support member positioned between said panels.

6. The lightweight beam of claim 5, wherein said separate support member is a wooden beam.

7. A lightweight pallet, comprising:

an upper sheet;

a lower sheet;

a plurality of lightweight beams attached between a lower surface of said upper sheet and an upper surface of said lower sheet, each beam of said lightweight beams comprising a sheet of cardboard having a plurality of panels, each of said panels being separated by a fold so that said sheet has a plurality of folds, said folds laying parallel with one another, wherein assembly of said beam includes folding said sheet, said sheet also including means for securing said panels so as to inhibit disassembly, said securing means including first and second tabs, each of said first and second tabs folding with respect to one of said panels so that said first and second tabs interlock with one another; and means for attaching said upper and lower sheets to said plurality of beams thereby covering said securing means and preventing disassembly.

8. The lightweight pallet of claim 7, further comprising alignment means to align lightweight beams of said plurality of lightweight beams in parallel, said alignment means including alignment tabs, at least two of said tabs being on at least one of said upper and lower sheets on each side of each of said beams.

9. The lightweight pallet of claim 7, wherein at least one lightweight beam of said plurality of lightweight beams further comprises a separate support member for augmenting strength of said at least one lightweight beam, said separate support member positioned in a supported sidewall between two panels.

* * * * *